US007950985B2

(12) United States Patent
Zuniga et al.

(10) Patent No.: US 7,950,985 B2
(45) Date of Patent: May 31, 2011

(54) FLEXIBLE MEMBRANE FOR CARRIER HEAD

(75) Inventors: Steven M. Zuniga, Soquel, CA (US); Andrew J. Nagengast, Sunnyvale, CA (US); Jeonghoon Oh, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 12/791,808

(22) Filed: Jun. 1, 2010

(65) Prior Publication Data

US 2010/0240287 A1 Sep. 23, 2010

Related U.S. Application Data

(63) Continuation of application No. 11/741,692, filed on Apr. 27, 2007, now Pat. No. 7,727,055.

(60) Provisional application No. 60/891,705, filed on Feb. 26, 2007, provisional application No. 60/867,090, filed on Nov. 22, 2006.

(51) Int. Cl.
*B24B 5/35* (2006.01)

(52) U.S. Cl. ..... 451/398; 428/119; 428/120; 451/288; 451/290

(58) Field of Classification Search ..... 428/98, 428/119, 120, 121, 124, 223; 451/285, 286, 451/287, 288, 289, 290, 397, 398
See application file for complete search history.

(56) References Cited

U.S. PATENT DOCUMENTS

| | | | |
|---|---|---|---|
| 5,916,412 | A | 6/1999 | Nakashiba et al. |
| 5,964,653 | A | 10/1999 | Perlov et al. |
| 6,056,632 | A | 5/2000 | Mitchel et al. |
| 6,089,961 | A | 7/2000 | Cesna et al. |
| 6,159,079 | A | 12/2000 | Zuniga et al. |
| 6,186,880 | B1 | 2/2001 | Gonzalez et al. |
| 6,210,255 | B1 | 4/2001 | Zuniga et al. |
| 6,435,949 | B1 | 8/2002 | Katsuoka et al. |
| 6,450,868 | B1 | 9/2002 | Zuniga et al. |
| 6,483,354 | B1 | 11/2002 | Gasparik |
| 6,602,116 | B1 | 8/2003 | Prince |
| 6,648,740 | B2 | 11/2003 | Perlov et al. |
| 6,663,466 | B2 | 12/2003 | Chen et al. |
| 6,722,965 | B2 | 4/2004 | Zuniga et al. |
| 6,857,931 | B2 | 2/2005 | Chen et al. |
| 6,857,945 | B1 | 2/2005 | Chen et al. |
| 6,872,130 | B1 | 3/2005 | Zuniga |
| 6,890,249 | B1 | 5/2005 | Zuniga et al. |
| 7,044,838 | B2 | 5/2006 | Maloney et al. |
| 7,081,042 | B2 | 7/2006 | Chen et al. |
| 7,101,272 | B2 | 9/2006 | Chen et al. |
| 7,101,273 | B2 | 9/2006 | Tseng et al. |
| 7,198,561 | B2 | 4/2007 | Chen et al. |
| 7,255,771 | B2 | 8/2007 | Chen et al. |
| 7,575,504 | B2 | 8/2009 | Zuniga et al. |

(Continued)

FOREIGN PATENT DOCUMENTS

| | | |
|---|---|---|
| EP | 1038636 | 9/2000 |

(Continued)

*Primary Examiner* — Timothy V Eley
(74) *Attorney, Agent, or Firm* — Fish & Richardson P.C.

(57) ABSTRACT

A carrier head that has a base assembly, a retaining ring assembly, a carrier ring, and a flexible membrane is described. The flexible membrane has a main portion and an outer annular portion, wherein a junction between the main portion and the outer annular portion comprises a peripheral edge hinge and an annular recess above the hinge along the outer wall of the outer annular portion.

14 Claims, 7 Drawing Sheets

U.S. PATENT DOCUMENTS

| | | | |
|---|---|---|---|
| 7,654,888 | B2 | 2/2010 | Zuniga et al. |
| 7,727,055 | B2 | 6/2010 | Zuniga et al. |
| 2005/0215182 | A1 | 9/2005 | Fuhriman et al. |

FOREIGN PATENT DOCUMENTS

| | | |
|---|---|---|
| WO | WO 99/02304 | 1/1999 |
| WO | WO 01/72473 | 10/2001 |
| WO | WO 2006/049269 | 5/2006 |

FIG. 2A
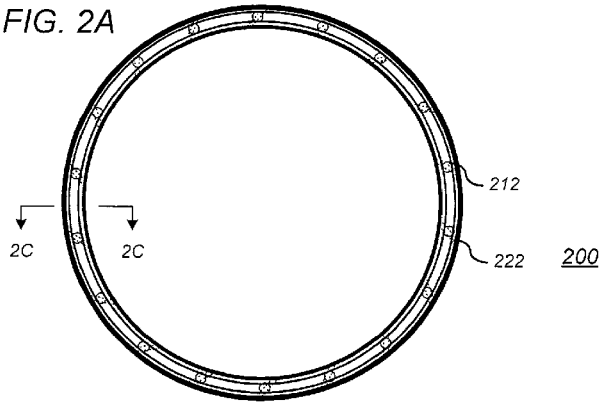
FIG. 2B
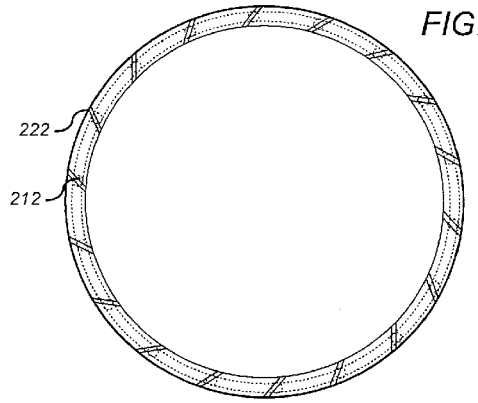
FIG. 2C
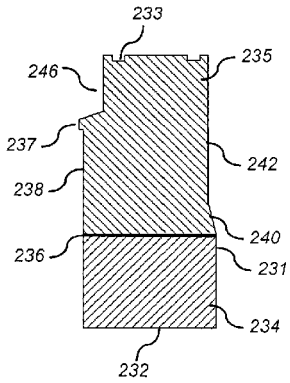
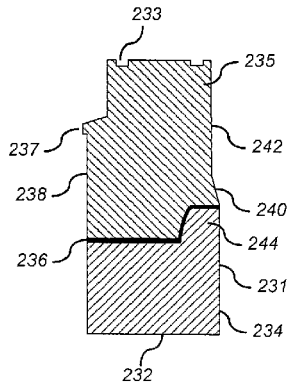
FIG. 2D

FIG. 4A
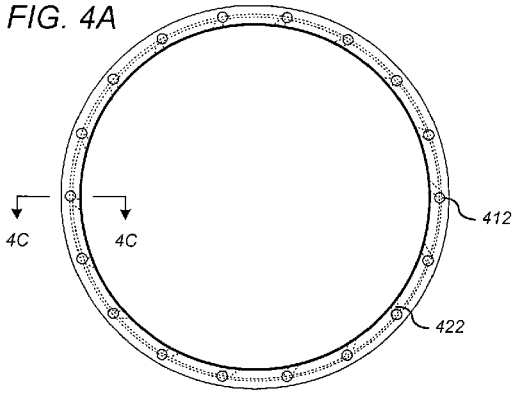
FIG. 4B
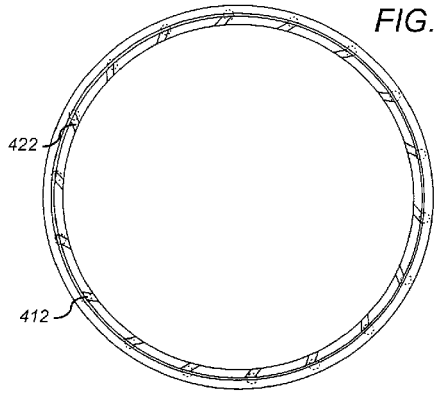
400
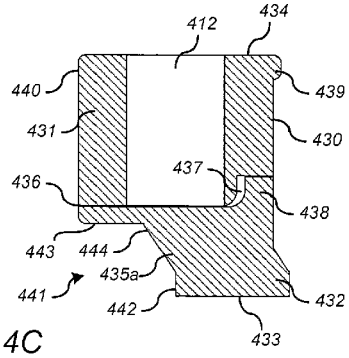
FIG. 4C

FLEXIBLE MEMBRANE FOR CARRIER HEAD

CROSS REFERENCE TO RELATED APPLICATIONS

This application is a continuation of U.S. patent application Ser. No. 11/741,692, filed Apr. 27, 2007, which claims priority to U.S. Provisional Application 60/867,090, filed Nov. 22, 2006 and to U.S. Provisional Application 60/891,705, filed Feb. 26, 2007. The disclosure of the prior applications is considered part of (and is incorporated by reference in) the disclosure of this application.

BACKGROUND

This invention relates generally to chemical mechanical polishing of substrates, and more particularly to a carrier head for use in chemical mechanical polishing.

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a standard pad or a fixed-abrasive pad. A standard pad has a durable roughened surface, whereas a fixed-abrasive pad has abrasive particles held in a containment media. The carrier head provides a controllable load on the substrate to push it against the polishing pad. The carrier head has a retaining ring which holds the substrate in place during polishing. A polishing liquid, such as a slurry, including at least one chemically-reactive agent and abrasive particles, is supplied to the surface of the polishing pad.

SUMMARY

On one aspect, a retaining ring assembly is described. The retaining ring assembly has a flexible membrane shaped to provide an annular chamber and an annular retaining ring positioned beneath the flexible membrane. The flexible membrane has concentric inner and outer side walls, annular concentric rims extending horizontally from the top edge of the inner and outer side walls, an annular lower surface, and two annular concentric projections extending downwardly from the annular lower surface. The annular retaining ring has an inner surface configured to circumferentially surround the edge of a substrate to retain the substrate, a lower surface configured to contact a polishing pad, an annular upper surface, and two annular concentric recesses in the annular upper surface. The annular concentric projections of the flexible membrane are sized to fit into the annular concentric recesses of the annular retaining ring.

Implementations of the invention may include one or more of the following features. The concentric inner and outer side walls of the flexible membrane may have curved portions extending below the upper annular surface of the retaining ring. The annular concentric rims and the annular concentric projections of the flexible membrane may be thicker than the inner and outer side walls. The annular lower surface of the flexible membrane may have a plurality of circular holes, each circular hole positioned between the two annular concentric projections extending downwardly from the annular lower surface. The annular upper surface of the retaining ring may have a plurality of cylindrical recesses, each cylindrical recess positioned between the two annular concentric recesses, allowing the flexible membrane to be secured to the retaining ring with fasteners. The flexible membrane may be clamped to a carrier head. The flexible membrane may be formed of an elastic material, such as silicone. The annular retaining ring may have an annular lower portion, an annular upper portion, and a bonding layer between the upper and lower portions. The annular lower portion of the retaining ring may have a plurality of grooves. The annular upper portion of the retaining ring may have an annular lip along its outer surface, wherein the annular lip has a horizontal lower surface, a vertical outer surface, and a non-horizontal upper surface. The annular upper portion of the retaining ring may have a lower annular surface and an upper annular surface, wherein the lower annular surface is wider than the upper annular surface.

In another aspect, a retaining ring is described. The retaining ring includes an annular ring having an inner surface configured to circumferentially surround the edge of a substrate to retain the substrate, a lower surface configured to contact a polishing pad, an annular upper surface, two annular concentric recesses in the annular upper surface, and a plurality of cylindrical recesses, each cylindrical recess positioned between the two annular concentric recesses.

Implementations of the invention may include one or more of the following features. The annular ring may have an annular lower portion with the lower surface and an annular upper portion with the upper surface, the upper portion and lower portion may be formed of different materials, and the upper portion may be joined to the lower portion, e.g., by a bonding layer. The annular lower portion may have a projection extending into a corresponding recess in the upper portion, and the projection may extend along the inner surface of the retaining ring. The upper portion may be harder than the lower portion. A lower annular surface of the retaining ring may be wider than an upper annular surface of the retaining ring. The lower surface may include a plurality of grooves extending from the inner surface to an outer surface. An outer surface of the retaining ring may have an annular lip. The annular lip may have a horizontal lower surface and a sloped upper surface. The outer surface may be recessed above the annular lip. The inner surface may include a region that is tapered inwardly from top bottom to top.

In another aspect, a flexible membrane for applying a load to a retaining ring is described. The flexible membrane includes concentric inner and outer side walls to surround an annular chamber, annular concentric rims extending horizontally from the top edge of the inner and outer side walls, an annular lower surface connected to the side wall, and two annular concentric projections extending downwardly from the annular lower surface.

Implementations of the invention may include one or more of the following features. The concentric inner and outer side walls of the flexible membrane may have curved portions extending below the annular lower surface. The annular concentric rims and the annular concentric projections of the flexible membrane may be thicker than the inner and outer side walls. The annular lower surface of the flexible membrane further may include a plurality of holes, e.g., circular holes, each hole positioned between the two annular concentric projections. The holes may be spaced at equal angular intervals around the lower surface. The flexible membrane is formed of an elastic material, e.g., silicone.

In another aspect, a carrier ring is described. The carrier ring includes an annular ring having an inner surface configured to circumferentially surround a retaining ring, a lower surface configured to contact a polishing pad, and an upper surface configured to be attached to a carrier head. The inner surface includes a first region adjacent the lower surface with a smaller inner diameter than a second region of the inner surface adjacent and above the first region.

Implementations of the invention may include one or more of the following features. The lower surface may have a smaller inner diameter than the upper surface. An outer surface of the carrier ring may have a recess adjacent the lower surface. The recess may include a horizontal lower surface, a vertical surface, and a sloped section connecting the horizontal lower surface and the vertical surface. The vertical surface may extend from the lower surface to the sloped section. The recess may define an annular step in the outer surface, and the annular step may have a second vertical surface extending from the lower surface and a second horizontal lower surface connecting the vertical surface and the second vertical surface. An inner diameter edge and an outer diameter edge of the upper surface may be rounded. A plurality of cylindrical recesses may be formed in the upper surface. The plurality of cylindrical recesses may be spaced at equal angular intervals around the upper surface. The lower surface may include a plurality of grooves extending from the inner surface to an outer surface. The carrier ring may be a single unit made of the same material, e.g., plastic. The carrier ring may include an annular upper portion having the upper surface and an annular lower portion having the lower surface, with the lower portion joined to the upper portion. The annular upper portion and the annular lower portion of the carrier ring may be are formed of different materials, for example, the upper portion may be formed of a metal and the lower portion may be formed of a plastic, e.g., a polyamidimid. A bonding layer may connect the upper portion and the lower portion. The annular lower portion may include an annular projection extending into an annular recess in the upper portion, and the annular projection may extend along the inner surface. The recess may define a horizontal upper surface, an inside wall and a rounded edge between the horizontal upper surface and the inside wall. The inner surface may have an inwardly protruding step adjacent the lower surface. The step may have a vertical inner wall and a horizontal upper surface. The inner surface may be tapered inwardly from bottom to top above the an inwardly protruding step. The carrier ring may have an inwardly protruding lip adjacent the upper surface. The lip may have a vertical inner wall and rounded portions along its upper and lower edges. The inner surface may be tapered inwardly from top to bottom below the lip.

In another aspect, a carrier ring is described. The carrier ring has an annular upper portion configured to be positioned beneath a base and an annular lower portion. The carrier ring is configured to circumferentially surround a retaining ring and has a lower surface configured to contact a polishing pad. The annular upper portion has rounded portions along the edge of its upper surface and its inner and outer diameters. The annular lower portion has a recess along its outer diameter and a lower surface with a smaller inner diameter than the upper surface of the annular upper portion.

Implementations of the invention may include one or more of the following features. The carrier ring may be attached to a base. The carrier ring may be configured to not contact the edge of a substrate. The annular upper portion may have a plurality of cylindrical recesses on its upper surface. The annular lower portion may have a plurality of grooves. The annular upper portion and the annular lower portion of the carrier ring may be a single unit made of the same material, such as plastic. The annular lower portion may include an annular step protruding outwardly from the recess along its outer diameter. The annular step may have a horizontal lower surface. The widest portion of the annular step as measured along a radial cross section of the annular lower portion may be at the uppermost edge of the annular step. The annular upper portion and the annular lower portion may be made of different materials with a bonding layer between the two portions. The annular upper portion may have a recess in its lower surface along its inner diameter, and the annular lower portion may have an annular projection protruding upwardly from its upper surface along its inner diameter, wherein the projection is sized to fit into the recess. The recess along the inner diameter of the annular upper portion may have a horizontal upper surface and a rounded portion along the inside wall. The annular upper portion may have an inwardly protruding lip along the inner diameter of its upper surface, wherein the lip may have a vertical inner wall and rounded portions along its upper and lower edges.

In another aspect, a flexible membrane is described. The flexible membrane has a main portion with a lower surface to provide a substrate-mounting surface, and an outer annular portion extending from the outer edge of the main portion. The juncture between the main portion and the outer annular portion has a peripheral edge hinge and an annular recess above the hinge along the outer wall of the outer annular portion. The peripheral edge hinge has rounded inner and outer surfaces and is configured to be compliant.

Implementations of the invention may include one or more of the following features. The outer annular portion may have an annular recess along its outer wall and an annular step protruding inwardly along its inner wall. The annular recess may allow the annular portion to flex. The annular step may have non-horizontal upper and lower surfaces. The flexible membrane may have two annular flaps connected to the outer annular portion. The two annular flaps connected to the outer annular portion may have a horizontal portion extending inwardly and a thick rim. The rim may be configured to be secured to a base assembly. The upper annular flap may have a narrower horizontal portion than the lower annular flap. A plurality of concentric annular flaps may be connected to the main portion to divide a volume above the main portion into a plurality of chambers when the flexible membrane is secured to a carrier head. For example, the flexible membrane may have have four concentric annular flaps connected to the main portion. The innermost concentric annular flap connected to the main portion may have a horizontal portion extending outwardly, a thick rim along the outer edge of the horizontal portion, and an annular angled portion joined between the main portion and the horizontal portion. The annular angled portion may have a larger radius at its juncture with the main portion than at its juncture with the horizontal portion. The three outermost concentric annular flaps connected to the main portion may each have a vertical portion extending from the main portion, a horizontal portion extending from the vertical portion, and a thick rim along the outer edge of the horizontal portion, wherein the thick rim may be secured to a base assembly. The horizontal portion may have a smaller thickness than the vertical portion of at least one of the three outermost concentric annular flaps connected to the main portion. The second and third outermost concentric annular flaps connected to the main portion may have a ratio of length of horizontal portion to length of vertical portion between about 1.5 and 2.0. At least one of the three outermost concentric annular flaps connected to the main portion may include a notch at the juncture between the horizontal portion and the vertical portion. The notch may allow the horizontal portion to flex vertically. At least one of the concentric annular flaps may include a notch at the juncture with the main portion. The notch may reduce compressions in the main portion. A first of the plurality of concentric annular flaps may include a laterally extending section and a vertically extending section connecting the laterally extending section to the main portion and a second of the plurality of concentric annular flaps may include a laterally extending section and a diagonally extending section connecting the laterally extending section to the main portion. The first of the plurality of concentric annular flaps may be an outermost flap, and the second of the plurality of concentric annular flaps may be an innermost flap.

In another aspect, a flexible membrane is described that has a main portion with a lower surface to provide a substrate-mounting surface, an outer annular portion extending from the outer edge of the main portion, and a plurality of concentric annular flaps connected to the main portion to divide a volume above the main portion into a plurality of chambers when the flexible membrane is secured to a carrier head. A first of the plurality of concentric annular flaps includes a laterally extending section and a vertically extending section connecting the laterally extending section to the main portion, and a second of the plurality of concentric annular flaps includes a laterally extending section and a diagonally extending section connecting the laterally extending section to the main portion Implementations of the invention may include one or more of the following features. The first of the plurality of concentric annular flaps can be an outermost flap. The second of the plurality of concentric annular flaps can be an innermost flap. The laterally extending section can have a smaller thickness than the vertically extending section of the first of the plurality of concentric annular flaps. A ratio of length of the laterally extending section to length of the vertically extending section of the first of the plurality of concentric annular flaps can be between about 1.5 and 2.0.

In another aspect, the invention is directed to a carrier head for chemical mechanical polishing of a substrate having a front surface, a back surface and an edge. The carrier head has a base assembly, an annular retaining ring positioned beneath the base assembly, a first flexible membrane shaped to provide an annular chamber positioned beneath the base assembly and above the annular retaining ring, a carrier ring circumferentially surrounding the retaining ring and configured to contact a polishing pad, and a second flexible membrane, wherein the volume between the base assembly and the second flexible membrane forms six pressurizable chambers. The annular retaining ring has two annular concentric recesses in an annular upper surface, a lower surface configured to contact a polishing pad, and an inner surface configured to circumferentially surround the edge of a substrate to retain the substrate. The first flexible membrane has two annular concentric projections extending downwardly from an annular lower surface, wherein the annular concentric projections are sized to fit into the annular concentric recesses of the annular retaining ring. The carrier ring has an annular upper portion and an annular lower portion, wherein the lower portion has a recess along its outer diameter. The second flexible membrane has a main portion with a lower surface to provide a substrate-mounting surface and an outer annular portion extending from the outer edge of the main portion, wherein a juncture between the main portion and the outer annular portion comprises a peripheral edge hinge and an annular recess above the hinge along the outer wall of the outer annular portion. The peripheral edge hinge has rounded inner and outer surfaces and is configured to be compliant.

Implementations of the invention may include one or more of the following features. The carrier head may further include a housing portion to be secured to a drive shaft, wherein the base assembly may be connected to the housing portion. The carrier ring may be configured to apply a downward pressure to a polishing pad. The downward pressure applied by the carrier ring may be greater than the downward pressure applied by the retaining ring. The carrier ring may be formed of a more rigid material than the retaining ring. The grooves in the annular lower portion of the carrier ring may be at least as wide as the grooves in the annular lower portion of the retaining ring. The carrier head may have a coating comprised of aluminum. The second flexible membrane may have a plurality of annular flaps, where at least one of the annular flaps may include a notch positioned and configured to reduce downward load transmitted from at least one of the chambers through the at least one of the annular flaps to the main portion of the membrane so as to reduce compressions in the main portion. The second flexible membrane may have a plurality of annular flaps, where at least one of the annular flaps may include a notch adapted to allow the at least one of the annular flaps to flex when the pressure is unequal in adjacent pressurizeable chambers.

In another aspect, a carrier head for chemical mechanical polishing of a substrate on a polishing pad is described. The carrier head has a base, an annular retaining ring and a carrier ring. The retaining ring has an inner surface configured to circumferentially surround the edge of a substrate to retain the substrate, an outer surface, and a lower surface to contact a polishing pad. The carrier ring has an inner surface circumferentially surrounding the retaining ring, an outer surface, an outer surface, and a lower surface to contact a polishing pad. The lower surface of the retaining ring has a plurality of grooves extending from the inner surface of the retaining ring to the outer surface of the retaining ring, the lower surface of the carrier ring has a plurality of grooves extending from the inner surface of the carrier ring to the outer surface of the carrier ring, and the plurality of grooves in the lower surface of the carrier ring are wider than the plurality of grooves in the lower surface of the retaining ring.

Implementations of the invention may include one or more of the following features. The carrier head may include a substrate backing member having a substrate mounting surface, and a load from the substrate mounting surface on the substrate, a load from the retaining ring on the polishing pad and a load from the carrier ring on the polishing pad may be independently adjustable. The substrate backing member may include a flexible membrane. The plurality of grooves in the lower surface of the carrier ring may be about twice as wide as the plurality of grooves in the lower surface of the retaining ring. The plurality of grooves in the lower surface of the carrier ring may be aligned with the plurality of grooves in the lower surface of the retaining ring.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 2A is a top view of one implementation of a retaining ring.

FIG. 2B is a bottom view of one implementation of a retaining ring.

FIG. 2C is a cross-sectional view of one implementation of a retaining ring.

FIG. 2D is a cross-sectional view of another implementation of a retaining ring.

FIG. 4A is a top view of one implementation of a carrier ring.

FIG. 4B is a bottom view of one implementation of a carrier ring.

FIG. 4C is a cross-sectional view of one implementation of a carrier ring.

Like reference symbols in the various drawings indicate like elements.

DETAILED DESCRIPTION

Figure 1:
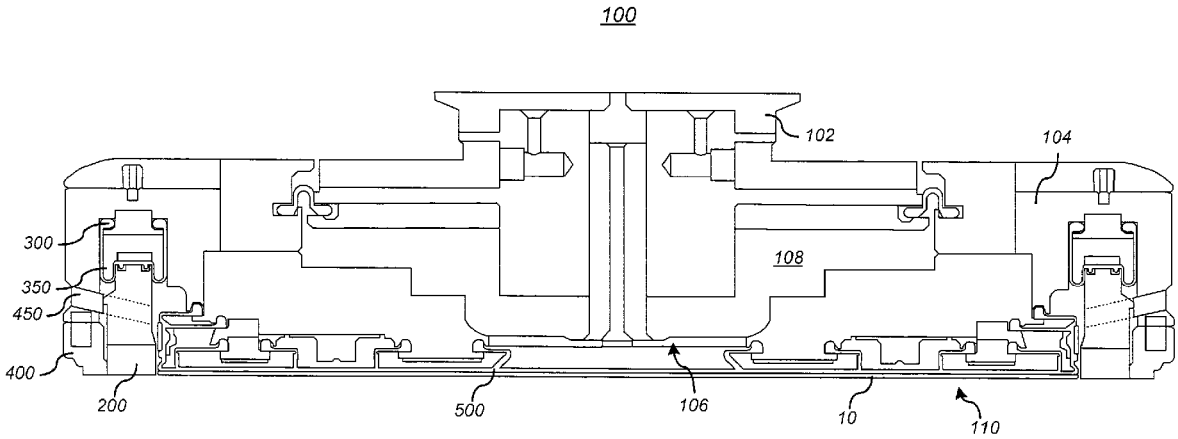
FIG. 1 shows a schematic cross-sectional view of a carrier head according to the present invention.

Referring to FIG. 1, a substrate 10 will be polished by a chemical mechanical polishing (CMP) apparatus that has a carrier head 100. A description of a CMP apparatus may be found in U.S. Pat. No. 5,738,574, the entire disclosure of which is incorporated herein by reference.

The carrier head 100 includes a housing 102, a base assembly 104, a gimbal mechanism 106 (which may be considered part of the base assembly 104), a loading chamber 108, a retaining ring assembly including a retaining ring 200 and a first flexible membrane 300 shaped to provide an annular chamber 350, a carrier ring 400, and a substrate backing assembly 110 which includes a second flexible membrane 500 that defines a plurality of pressurizable chambers. Other features of the carrier head described for a similar carrier head may be found in U.S. Patent Application Publication No. 2006/0154580, the entire disclosure of which is incorporated herein by reference.

The housing 102 can generally be circular in shape and can be connected to a drive shaft to rotate therewith during polishing. There may be passages (not illustrated) extending through the housing 102 for pneumatic control of the carrier head 100. The base assembly 104 is a vertically movable assembly located beneath the housing 102. The gimbal mechanism 106 permits the base assembly 104 to gimbal relative to the housing 102 while preventing lateral motion of the base assembly 104 relative to the housing 102. The loading chamber 108 is located between the housing 102 and the base assembly 104 to apply a load, i.e., a downward pressure or weight, to the base assembly 104. The vertical position of the base assembly 104 relative to a polishing pad is also controlled by the loading chamber 108. The substrate backing assembly 110 includes a flexible membrane 500 with a lower surface 512 that can provide a mounting surface for a substrate 10.

Referring to FIGS. 2A-3B, a substrate 10 can be held by a retaining ring assembly clamped to a base assembly 104. The retaining ring assembly can be constructed from a retaining ring 200 and a flexible membrane 300 shaped to provide an annular chamber 350. The retaining ring 200 can be positioned beneath the flexible membrane 300 and configured to be secured to the flexible membrane 300.

As shown in FIG. 2A-2C, the retaining ring 200 has an inner surface 231 and a lower surface 232. The inner surface 231 can be configured to circumferentially surround the edge of a substrate 10 to retain the substrate during polishing. The lower surface 232 of the retaining ring 200 can be brought into contact with a polishing pad. The retaining ring 200 has an annular upper surface that can have two annular concentric recesses 233. These annular concentric recesses 233 can be sized to interlock with a flexible membrane 300 positioned above the retaining ring 200.

The retaining ring 200 can be constructed from two rings, a lower annular portion 234 and an upper annular portion 235. The lower portion 234 can be formed of a material which is chemically inert in a CMP process, such as a plastic, e.g., polyphenylene sulfide (PPS). The lower portion should also be durable and have a low wear rate. In addition, the lower portion should be sufficiently compressible so that contact of the substrate edge against the retaining ring does not cause the substrate to chip or crack. On the other hand, the lower portion should not be so elastic that downward pressure on the retaining ring causes the lower portion to extrude into the substrate receiving recess. The lower portion of the retaining ring can have an inner diameter just larger than the substrate diameter, e.g., about 1-2 mm larger than the substrate diameter, so as to accommodate positioning tolerances of the substrate loading system. The retaining ring can have a radial width of about half an inch.

The upper portion 235 of the retaining ring 200 can be formed of a material that is more rigid than the lower portion 234. The rigid material can be a metal, e.g., stainless steel, molybdenum, or aluminum, or a ceramic, e.g., alumina, or other exemplary materials.

When the two rings 234, 235 of the retaining ring are joined, the upper surface of the lower portion 234 is positioned adjacent to the lower surface of the upper portion 235. The two rings generally have substantially the same dimensions at the inner and outer diameters on their adjacent surfaces such that the two rings 234, 235 form a flush surface where the two rings 234, 235 meet when they are joined.

The two annular portions can be attached with a bonding layer 236 between their adjacent surfaces. The bonding layer 236 between the two rings can prevent trapping of slurry in the retaining ring. The bonding layer can be made of an adhesive material, such as a slow-curing or a fast-curing epoxy. High temperature epoxy resists degradation of the bonding layer 236 due to high heat during the polishing process. In certain implementations, the epoxy includes polyamide and aliphatic amines.

The upper surface of the upper portion 235 can include cylindrical recesses or holes 212 with screw sheaths (not shown) to receive fasteners, such as bolts, screws, or other hardware, for securing the retaining ring 200 to the flexible membrane 300 positioned above it. The holes 212 can be evenly spaced around the retaining ring and are positioned between the two annular concentric recesses 233.

In some implementations, the retaining ring 200 has one or more slurry transport channels 222 formed in the lower surface 232. The slurry transport channels extend from the inner diameter to the outer diameter of the lower portion 234 for allowing slurry to pass from the exterior to the interior of the retaining ring during polishing. The slurry transport channels 222 can be evenly spaced around the retaining ring. Each slurry transport channel 222 can be offset at an angle, e.g., 45°, relative to the radius passing through the channel. The channels can have a width of about 0.125 inches.

In some implementations, the retaining ring 200 has one or more through holes that extend through the body of the retaining ring from the inner diameter to the outer diameter for allowing fluid, e.g., air or water, to pass from the interior to the exterior, or from the exterior to the interior, of the retaining ring during polishing. The through-holes can extend through the upper portion 235. The through holes can be evenly spaced around the retaining ring.

In some implementations, the upper portion 235 of the retaining ring can have a lip 237 along its outer surface 238. The lip can have a horizontal lower surface, a vertical outer surface, and a sloping, non-horizontal upper surface. The lip 237 can provide a hard stop for the retaining ring against the top inner edge of the carrier ring 400 as the retaining ring wears during substrate polishing.

In some implementations, the outer surface 238 of the upper portion 235 can form a recess 246 above the lip 237 (the portion of the outer surface above the lip is recessed relative to the portion of the outer surface below the lip). This recess 246 provides space for the side walls 324 of the flexible membrane 300 to roll when the chamber 350 is evacuated.

In some implementations the upper portion 235 of the retaining ring can be wider at its lower surface than its upper surface. For example, the inner surface 231 can have a tapered region 240 sloped inwardly (i.e., having decreasing diameter) from top to bottom below a vertical region 242. The tapered region 240 can be adjacent the lower surface of the upper portion 235. The inner surface of the lower portion 234 can be vertical. As the lower portion of the retaining ring wears during substrate polishing, the narrower upper inner surface of the retaining ring prevents wear on an adjacent flexible membrane that provides a substrate-mounting surface. In addition, in some implementations, the entire outer surface of the retaining ring can be coated with a non-stick coating, e.g., parylene.

In some implementations, shown in FIG. 2D, the upper surface of the lower portion 234 has a projection 244 that extends into a corresponding recess in the lower surface of the upper portion 235. The projection 244 can be annular, e.g., extending around the retaining ring, and can be positioned at the inner surface of the retaining ring to provide a step-like feature. The bonding layer 236 can extend along the outer vertical wall of the projection 244. In operation, this step feature transfers shear force on the lower portion 234 from the polishing pad into a lateral force on the vertical wall 230 of the projection 244 and a compressive force on the associated portion of the bonding layer 236. The tapered region 240 is illustrated as part of the upper portion 235 adjacent the projection 244, but the tapered region 240 could be part of the lower portion 234, e.g., the inner surface of the projection 244 could be tapered.

The retaining ring 200 and a flexible membrane 300 together form the retaining ring assembly. The flexible membrane 300 is configured to be clamped above to a base assembly 104 and secured below to an annular retaining ring 200, providing an annular chamber 350 above the retaining ring. When the annular chamber 350 is pressurized, the flexible membrane provides an independently controllable load on the retaining ring. The load on the retaining ring provides a load to a polishing pad. Independent loading on the retaining ring can allow consistent loading on the pad as the ring wears. Positioning the flexible membrane between the retaining ring and the carrier head can reduce or eliminate the impact of carrier distortion on the retaining ring which occurs when the ring is directly secured to the carrier head. The elimination of this carrier distortion reduces the uneven wear on the retaining ring, reduces process variability at the substrate edge, and enables lower polishing pressures to be used, increasing ring lifetime.

Figure 3A:
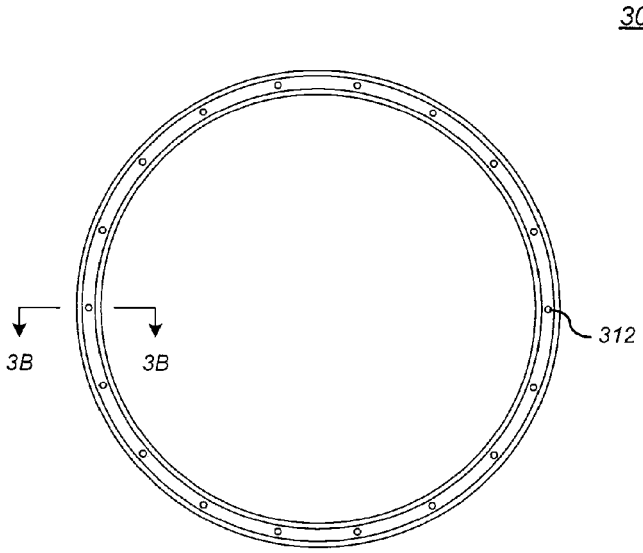
FIG. 3A is a top view of one implementation of a flexible membrane.
Figure 3B:
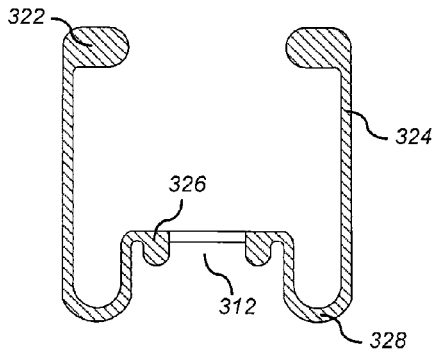
FIG. 3B is a cross-sectional view of one implementation of a flexible membrane.

As shown in FIGS. 3A-3B, the flexible membrane 300 has concentric inner and outer side walls 324. The flexible membrane 300 can have a pair of annular rims 322 extending horizontally and inwardly from the top edge of the side walls 324. The flexible membrane can be clamped to a base assembly 104 with a clamp ring positioned below the annular rims 322 of the flexible membrane. Additionally, the flexible membrane 300 has a lower surface. There can be two annular concentric projections 326 extending downwardly from the annular lower surface of the flexible membrane. These annular concentric projections 326 can be sized to fit into the annular concentric recesses 233 in the top surface of the retaining ring 200 positioned below the flexible membrane.

The flexible membrane 300 of the retaining ring assembly can be formed of a material that is elastic, allowing the membrane to flex under pressure. The elastic material can include silicone and other exemplary materials.

The lower surface of the flexible membrane can include circular holes 312. The circular holes 312 can be positioned between the two annular concentric projections 326 and can be evenly spaced around the lower surface of the flexible membrane. The circular holes 312 can accommodate fasteners, such as bolts, screws, or other hardware, for securing the flexible membrane 300 to the retaining ring 200. In some implementations, to secure the flexible membrane 300 to the retaining ring 200, an adhesive, e.g., Loctite, is placed in the recesses 212, and one-way screws are inserted through the holes 312 in the flexible membrane 300 into the receiving recesses 212. Thus, the flexible membrane 300 can be effectively permanently joined to the retaining ring 200.

In some implementations, the concentric inner and outer side walls 324 of the flexible membrane 300 can wrap around below to form a lower surface with curved portions 328. When the flexible membrane is secured to a retaining ring 200, the curved portions 328 can extend below the upper surface of the retaining ring. The curved portions 328 provide a rolling hinge that permits the bottom of the flexible membrane to move up and down in response to pressurization or evacuation of the chamber 350 without substantial bulging of the side walls 324. In some embodiments, the annular rims 322 can be thicker than the side walls 324 of the flexible membrane. The annular concentric projections 326 can also be thicker than the side walls 324.

While the retaining ring 200 is configured to retain a substrate 10 and provide active edge process control, the carrier ring 400 provides positioning or referencing of the carrier head to the surface of the polishing pad. In addition, the carrier ring 400 contacts and provides lateral referencing of the retaining ring 200. The carrier ring 400 is configured to circumferentially surround a retaining ring 200. Like the retaining ring, the lower surface 433 of the carrier ring 400 can be brought into contact with a polishing pad.

As shown in FIG. 4A-4C, the carrier ring 400 can have an annular upper portion 431 and an annular lower portion 432. The upper portion 431 can be positioned beneath a base assembly 104 and can have rounded portions along the inner and outer diameters of its upper surface 434. The inner diameter of the section of the lower portion 432 that contacts the retaining ring 200 is just larger than the outer diameter of the associated portion of the retaining ring; if the retaining ring is about half an inch wide, then the inner diameter of the carrier ring will be about an inch larger than the substrate, for example, an inner diameter of about 13 inches for a 300 mm (12 inch) substrate.

The lower portion 432 can have a recess 441 along its outer diameter 440. The recess 441 can be defined by a vertical surface 442 extending from the bottom surface 433, a horizontal surface 443 extending from the outer diameter 440, and a sloped surface 444 connecting the vertical surface 442 to the horizontal surface 443. The widest part of the sloping portion, as measured along a radial cross section, can be at the uppermost edge of the sloping surface 444. The lower portion 432 can have a rounded portion along the edge of the outer diameter 440 and the horizontal surface 443.

Figure 4D:
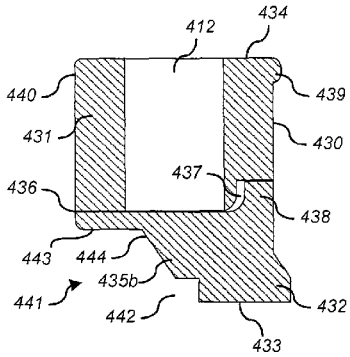
FIGS. 4D and 4F are a cross-sectional views of other implementations of a carrier ring.

As shown in FIG. 4D, in some implementations, the recess 441 is further defined by an annular step 435*b* protruding outwardly. The annular step 435*b* can have a horizontal lower surface, a sloped surface, and a rounded portion along the edge of the two surfaces. The widest portion of the annular step 435*b*, as measured along a radial cross section of the lower portion 432, can be at the uppermost edge of the annular step 435*b*.

Figure 4E:
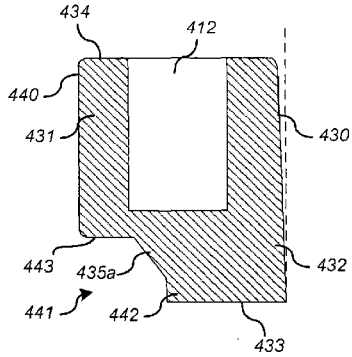
FIGS. 4E, 4G and 4H are a cross-sectional views of implementations of a unitary carrier ring.

In some implementations, as shown in FIG. 4C, the carrier ring has an inwardly protruding step in the lower portion 432 along the inner surface 430. In other implementations, as shown in FIG. 4E, the carrier ring has an inner surface 430 which is not perpendicular, as represented by the dashed line in FIG. 4E, to the lower surface 433 of the carrier ring (although FIG. 4E and illustrates a single-piece ring, the sloped inner surface could be applicable to a two-part ring as shown in FIGS. 4C and 4D). The inner surface 430 can incline outwardly from top to bottom, with the region of the inner surface 430 adjacent the lower surface 433 being inclined. The smaller inner diameter adjacent the lower surface 433 (whether due to the bump or inclined surface) relative to higher regions of the inner surface allows the carrier ring to laterally reference the retaining ring 200, and provides for consistency in the location of contact between the retaining ring and the carrier ring, even as the carrier ring wears during polishing of the substrate. In addition, placement of the feature at the bottom of the carrier ring can prevent torquing of the retaining ring when the retaining ring contacts the carrier ring. In some implementations, the lower surface 433 of the lower portion 432 has a smaller inner diameter than the upper surface 434 of the upper portion 431.

Figure 4F:
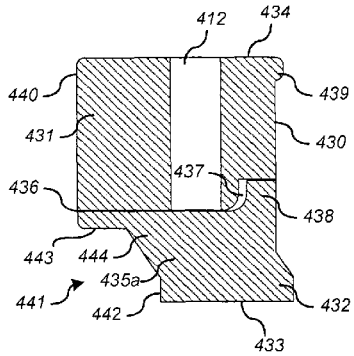

The carrier ring can be attached to a base assembly 104. Generally, the carrier ring is configured to surround a retaining ring 200 and not to contact the edge of a substrate 10. The upper portion 431 of the carrier ring 400 can include cylindrical recesses or holes 412 with screw sheaths (not shown) to receive fasteners, such as bolts, screws, or other hardware, for securing the carrier ring 400 to a base assembly 104. The holes 412 can be evenly spaced around the carrier ring. In some implementations, the holes 412 do not extend over the horizontal surface 433 of the recess 441. For example, as shown in FIG. 4F, the holes can be located entirely above the flat lower surface 433. Additionally, one or more alignment features, such as apertures or projections (not shown), can be located on the top surface 434 of the upper portion 431. If the carrier ring has an alignment aperture, the base assembly 104 can have a corresponding pin that mates with the alignment aperture when the base assembly 104 and carrier ring are properly aligned.

Figure 6:
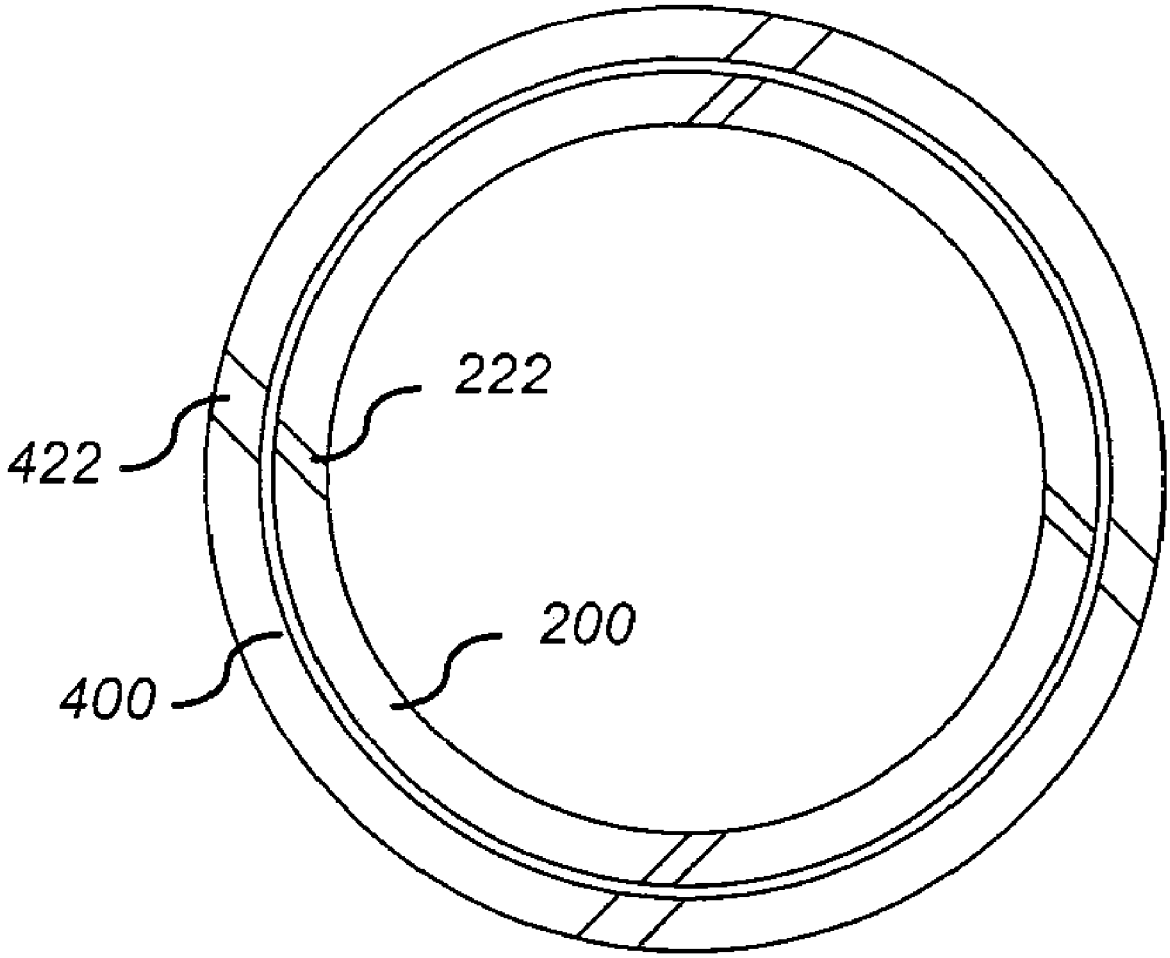
FIG. 6 is a bottom view of a carrier head.

In some implementations, the carrier ring 400 has one or more through slurry transport channels 422 on the bottom surface 433 that extend from the inner diameter to the outer diameter of the lower portion 432 for allowing slurry to pass from the exterior to the interior of the carrier ring during polishing. The channels 422 can be evenly spaced around the carrier ring. Each slurry transport channel 422 can be offset at an angle, e.g., 45°, relative to the radius passing through the channel. Referring to FIG. 6, the carrier ring channels 422 can be aligned with the retaining ring channels. In some embodiments, the carrier ring channels 422 are wider than the retaining ring channels 222, allowing slurry to pass more freely to the interior of the retaining ring 200. For example, the carrier ring channels 422 can have a width of about 0.25 inches.

In some implementations, the carrier ring 400 has one or more through holes that extend from the inner diameter to the outer diameter for allowing slurry or air to pass from the interior to the exterior, or from the exterior to the interior, of the carrier ring during polishing. The through-holes can extend through the upper portion 431. The through holes can be evenly spaced around the carrier ring. In some implementations, there are through holes in the carrier ring but not in the retaining ring. Thus, fluid, e.g., water from a cleaning system, that is sprayed through the through holes in the carrier ring will be flushed downward along the outer surface of the retaining ring, thus clearing the space between the carrier ring and retaining ring. In other implementations, there are through holes in both the carrier ring but not in the retaining ring, and the through holes are aligned so that fluid will pass through both the carrier ring and the retaining ring. In such implementations, the through holes through the carrier ring 400 can be the same width or wider than the through holes through the retaining ring 200. In some implementations (see FIG. 1), through holes 450 are formed through a portion of the housing 104 that surrounds the retaining ring, rather than through the carrier ring itself.

Figure 4G:
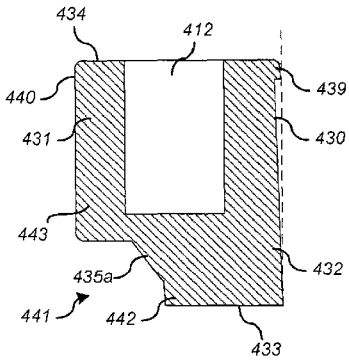
Figure 4H:
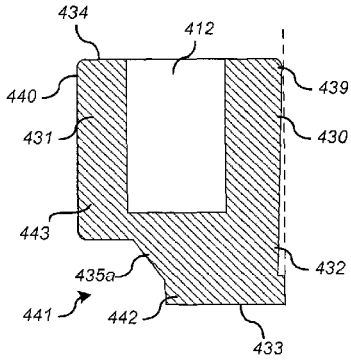

Returning to FIG. 4A-4C, in some implementations, the upper portion 431 can have an inwardly protruding lip 439 along its inner surface 430, where the lip has a vertical inner wall and rounded portions along its upper and lower edges. The protruding lip 439 can have an inner diameter equal to or less than the inner diameter of the step 432. The lip 439 can provide a hard stop to engage the lip 237 to prevent overextension of the retaining ring 200. In some implementations, as shown by FIG. 4G, the carrier ring 400 includes both a inclined inner surface and an inwardly protruding lip 439. In some other implementations, as shown by FIG. 4H, the inner surface of the carrier ring 400 has both an inwardly protruding step at the lower portion 432 and a sloped inner surface that is inclined outwardly from bottom to top.

In some implementations, shown in FIG. 4C, the upper portion 431 and the lower portion 432 of the carrier ring are made of different materials. The upper portion 431 can be formed of a material that is more rigid than the lower portion 432. The rigid material can be a metal, e.g., stainless steel, molybdenum, or aluminum, or a ceramic, e.g., alumina, or other exemplary materials. The lower portion 432 can be formed of a material which is chemically inert in a CMP process, such as a plastic, e.g., polyetheretherketone (PEEK), carbon filled PEEK, Teflon® filled PEEK, polyamidimid (PAI), or a composite material.

When the two portions 431, 432 of the carrier ring are joined, the upper surface of the lower portion 432 is positioned adjacent to the lower surface of the upper portion 431. The two portions generally have substantially the same dimensions at the inner and outer diameters on their adjacent surfaces such that the two portions 431, 432 form a flush surface where the two portions 431, 432 meet when they are joined. The two annular portions can be attached with a bonding layer 436 between their adjacent surfaces.

The lower portion 432 can have a step feature 438. The step feature 438 projects vertically from the lower portion 432 into a corresponding recess 437 in the upper portion 431. The step feature 438 is an annular step adjacent to the inner diameter of the carrier ring 400. The step feature 438 extends upwardly from a horizontal portion of the lower ring 432. The step feature 438 shares the inner diameter wall of the lower rings horizontal portion. The recess 437 in the upper portion 431 corresponds to the step feature 438, so that when the lower portion 432 and upper portion 431 are brought together, the step feature 438 fits into the recess 437 of the upper portion 431. The recess 437 can have a horizontal upper surface and a vertical inner wall with a rounded portion. In some implementations, the step 438 is only at the inner diameter of the lower ring 432 and is not at the outer diameter. That is, the carrier ring 400 may have no other step and corresponding recess features other than the step 438 and recess 437 at the inner diameter of the carrier ring. In some implementations, the bonding layer 436 may extend to the surface of the step 438 in the recess 437 of the carrier ring.

Shear force generated during rotation of the carrier ring exerts force on a horizontal bonding layer. In carrier ring 400, the step feature 438 transfers shear force into compressive force on the bonding layer 436 along the vertical inner wall of the step feature 438. The transfer of shear force to compressive force on the bonding layer 438 reduces the likelihood of delamination of the lower portion 432 from the upper portion 431 that can occur in carrier rings without a step feature. Also, the lateral forces produced by the horizontal motion of the carrier ring relative to the polishing pad as the carrier ring is pressed down against the polishing pad is transferred from the lower portion 432 to the base of the upper portion 431. In addition, the vertical inner wall provides a greater bonding area for the bonding layer 436 because of the increase of surface area in the interface. The larger bonding area also reduces the likelihood of delamination of the lower portion 432 from the upper portion 431. Further, the bonding layer 436 along the vertical inner wall absorbs stress resulting from uneven thermal expansion between material in the upper portion 431 (e.g., a rigid material such as stainless steel) and material in the lower portion 432 (e.g., a less rigid or more compliant material such a PEEK composite).

In some implementations, e.g., shown in FIGS. 4E, 4G and 4H, the upper portion 431 and the lower portion 432 of the carrier ring comprise a single unit made of the same material. The unitary carrier ring can be formed of a material which is chemically inert in a CMP process, such as a plastic, e.g., polyetheretherketone (PEEK), carbon filled PEEK, Teflon® filled PEEK, polyamidimid (PAI), or a composite material.

Figure 5:
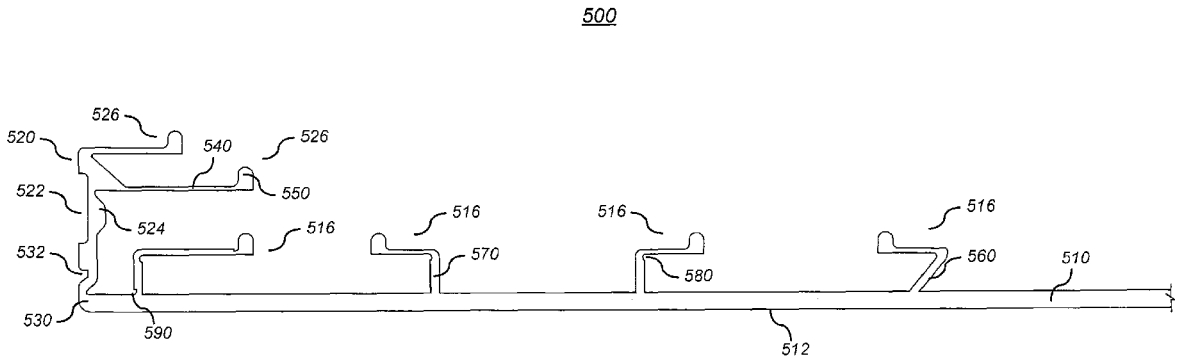
FIG. 5 is a partial cross-sectional view of a flexible membrane.

While the retaining ring 200 is configured to circumferentially surround the edge of a substrate 10 to retain the substrate, a flexible membrane 500 provides a surface 512 to mount the substrate 10. FIG. 5 shows a partial cross-sectional view of a flexible membrane 500, where only one-half of the cross section of the generally symmetric flexible membrane is shown.

As shown in FIG. 5, the flexible membrane 500 can have a generally flat main portion 510 and an outer annular portion 520. The main portion 510 provides a substrate-mounting surface 512. The outer portion 520 extends from the outer edge of the main portion 510. The juncture between the main portion 510 and the outer annular portion 520 can have a peripheral edge hinge 530 and an annular recess 532, located above the hinge 530 along the outer wall of the outer annular portion 520. The peripheral edge hinge 530 can have rounded portions along its inner and outer surfaces. The peripheral edge hinge 530 and the annular recess 532 can be configured to be compliant, improving the symmetry of loading on the periphery of the substrate 10.

The outer annular portion 520 can have an annular recess 522 along its outer wall, which is configured to allow the outer annular portion 520 to flex. The outer annular portion 520 can also have an annular step 524 protruding inwardly along its inner wall. The annular step 524 can have non-horizontal (i.e., sloping) upper and lower surfaces.

In some implementations, the flexible membrane 500 can have several annular flaps. The main portion 510 can have four concentric annular flaps 516. The outer annular portion 520 can have a pair of annular flaps 526. The annular flaps 526 connected to the outer annular portion 520 can have a horizontal portion 540 extending inwardly with a thick rim 550. The thick rims 550 can be configured to be secured to a base assembly 104. As shown in FIG. 5, the upper annular flap can have a horizontal portion which is narrower (i.e., does not extend as far inwardly) than the lower annular flap. In some embodiments, the outer annular portion 520 can have an annular triangular portion, and the horizontal portions 540 of the pair of annular flaps 526 can be connected to the outer annular portion 520 through the vertices of the annular triangular portion.

The innermost concentric annular flap 516 connected to the main portion 510 can include a horizontal portion extending outwardly with a thick rim, which can be configured to be secured to a base assembly 104, and an annular angled portion 560. The annular angled portion 560 can be joined between the main portion 510 and the horizontal portion of the annular flap 516. The annular angled portion 560 can have a larger radius at its juncture with the main portion 510 than at its juncture with the horizontal portion.

The three outermost concentric annular flaps 516 connected to the main portion 510 can include a vertical portion 570 extending from the main portion 510, and a horizontal portion extending from the vertical portion 570 with a thick rim along the outer edge of the horizontal portion, which can be configured to be secured to a base assembly 104. In some embodiments, the horizontal portion of a concentric annular flap 516 can have a smaller thickness than the vertical portion 570 of the concentric annular flap. In some implementations, the second and third outermost concentric annular flaps 516 can have a ratio of length of horizontal portion to length of vertical portion 570 between about 1.5 and 2.0, such as about 1.66.

In some implementations, an annular flap 516, 526 can have one or more indentations or notches (i.e., an annular recess). A concentric annular flap 516 can have a notch 580 at the juncture between its horizontal portion and its vertical portion 570. The notch 580 can allow the horizontal portion of the concentric annular flap 516 to flex vertically. A concentric annular flap 516 can have a notch 590 at its juncture with the main portion 510. The notch 590 can be configured to reduce compressions in the main portion 510.

In another aspect of the invention, as shown in FIG. 1, a carrier head for CMP can include a base assembly 104, an annular retaining ring 200 positioned beneath the base assembly 104 and configured to circumferentially surround the edge of a substrate 10 to retain the substrate, a first flexible membrane 300 shaped to provide an annular chamber 350 positioned beneath the base assembly 104 and above the annular retaining ring 200, a carrier ring 400 circumferentially surrounding the retaining ring 200, and a second flexible membrane 500 providing a substrate-mounting surface, wherein the volume created between the base assembly 104 and the second flexible membrane 500 forms six pressurizable chambers.

The pressurizable chambers can be formed by clamping the second flexible membrane 500 to the base assembly 104 with a plurality of concentric clamp rings. The chambers can be configured to be successively narrower, from the innermost chamber to the outermost chamber. The second outermost chamber, which is partially defined by the peripheral edge hinge 530, is narrowly configured to provide better edge control during polishing of the substrate.

Each chamber can be fluidly coupled by passages (not shown) through the base assembly 104 and housing 102 to an associated pressure source, such as a pump or pressure or vacuum line. There can be one passage for the annular chamber 350 of the first flexible membrane 300, one passage for the loading chamber 108, and one passage for each of the six pressurizable chambers between the base assembly 104 and the second flexible membrane 500, for a total of eight passages. One or more passages from the base assembly 104 can be linked to passages in the housing 102 by flexible tubing that extends inside the loading chamber 108 or outside the carrier head 100. Pressurization of each chamber, and the force applied by the associated segment of the main portion 510 of the flexible membrane 500 on the substrate 10, can be independently controlled. This permits different pressures to be applied to different radial regions of the substrate during polishing, thereby compensating for non-uniform polishing rates. In addition, the pressure on the retaining ring 200 can be varied independently of the pressure in the chambers defined by the membrane 500 using chamber 350, and the pressure on the carrier ring 400 can be varied relative to the pressures on the retaining ring 100 and in the chambers defined by the membrane 400 using the loading chamber 108.

A number of embodiments of the retaining ring 200, first flexible membrane 300, the carrier ring 400, and the second flexible membrane 500, as described above, can be implemented in the carrier head.

Generally, the carrier head can further comprise a housing 102 connected to the base assembly 104 and configured to be secured to a drive shaft. The carrier head can be coated with a material, e.g., aluminum, PEEK, or a composite material. The carrier ring 400 of the carrier head can apply a downward pressure to a polishing pad. In some embodiments, the downward pressure applied by the carrier ring 400 is greater than the downward pressure applied by the retaining ring 200. The carrier ring 400 can be formed of a more rigid material than the retaining ring 200, resulting in the carrier ring wearing at a lower rate than the retaining ring. The widths of the retaining ring 200 and the carrier ring 300 can be varied to adjust process results. In particular, the polishing profile on the substrate edge can be altered by changing the width and pressure to each ring.

In some embodiments, the retaining ring 200 can have slots or through holes, as indicated by the dashed lines in FIG. 1, that extend from the inner surface 231 to the outer surface 238 of the retaining ring 200 for allowing fluid to pass from the interior to the exterior, or from the exterior to the interior, of the ring. These slots can align with slots in the carrier head 100 and can provide a means to wash excess slurry from the interior of the retaining ring 200.

In some implementations, having notches 580, 590 in a concentric annular flap 516 of the second flexible membrane 500 can improve polishing uniformity. A potential advantage of notches is to improve polishing uniformity when there is unequal pressure in adjacent chambers. Specifically, when there is unequal pressure in adjacent chambers, the pressure in the high pressure chamber tends to bow the separating flap into the low pressure chamber. The bowing of the separating flap can lead to regions of compression in the main portion 510 adjacent to the separating flap, resulting in an unintended pressure distribution and non-uniform polishing. However, having a notch 590 at the junction between the main portion 510 and a vertical portion 570 makes the annular flap 516 more flexible at the juncture. This reduces compression in the main portion 510 when the flap bends due to unequal pressure, thereby improving polishing uniformity. A notch 590 can be adapted to allow the concentric annular flap 516 to flex when the pressure is unequal in adjacent pressurizeable chambers on both sides of the concentric annular flap 516. Furthermore, notches 580, 590 can be positioned and configured to reduce downward load transmitted from at least one of the pressurizable chambers through the concentric annular flap 516 to the main portion 510 so as to reduce compressions in the main portion 510.

A number of embodiments of the invention have been described. Nevertheless, it will be understood that various modifications may be made without departing from the spirit and scope of the invention. For example, several of the concentric annular flaps 216 of the second flexible membrane can have an annular angled portion 560 instead of an annular vertical portion 570. In addition, notches may be located in the middle of a vertical portion 570, at a juncture with the annular angled portion 560, or at the juncture between a horizontal portion 540 and a rim 550. Accordingly, other implementations are within the scope of the following claims.

What is claimed is:

1. A flexible membrane, comprising:

a main portion with a lower surface to provide a substrate-mounting surface; and an outer annular portion extending from an outer edge of the main portion;

wherein a juncture between the main portion and the outer annular portion comprises a peripheral edge hinge and an annular recess above the hinge along an outer wall of the outer annular portion, the peripheral edge hinge having rounded inner and outer surfaces and configured to be compliant.

2. The flexible membrane of claim 1, wherein the outer annular portion comprises an annular recess along the outer wall, and an annular step protruding inwardly along an inner wall of the outer annular portion, the annular step having non-horizontal upper and lower surfaces.

3. The flexible membrane of claim 1, further comprising:

two annular flaps connected to the outer annular portion to divide a volume above the main portion into a plurality of chambers when the flexible membrane is secured to a carrier head.

4. The flexible membrane of claim 3, wherein the two annular flaps connected to the outer annular portion comprise a horizontal portion extending inwardly and a thick rim, the rim configured to be secured to a base assembly, the two annular flaps including an upper annular flap and a lower annular flap, and wherein the upper annular flap has a narrower horizontal portion than the lower annular flap.

5. The flexible membrane of claim 1, further comprising:

a plurality of concentric annular flaps connected to the main portion to divide a volume above the main portion into a plurality of chambers when the flexible membrane is secured to a carrier head.

6. The flexible membrane of claim 5, wherein a first of the plurality of concentric annular flaps includes a laterally extending section and a vertically extending section connecting the laterally extending section to the main portion and a second of the plurality of concentric annular flaps includes a laterally extending section and a diagonally extending section connecting the laterally extending section to the main portion.

7. The flexible membrane of claim 6, wherein the first of the plurality of concentric annular flaps is an outermost flap.

8. The flexible membrane of claim 6, wherein the second of the plurality of concentric annular flaps is an innermost flap.

9. The flexible membrane of claim 6, wherein the second of the plurality of concentric annular flaps includes a notch at a juncture between the laterally extending section and the vertically extending lateral section.

10. The flexible membrane of claim 5, wherein an innermost concentric annular flap of the plurality of concentric flaps comprises a horizontal portion extending outwardly, a thick rim along an outer edge of the horizontal portion, the thick rim configured to be secured to a base assembly, and an annular angled portion joined between the main portion and the horizontal portion, wherein the annular angled portion has a larger radius at a juncture between the annular angled portion and the main portion than at a juncture between the annular angled portion and the horizontal portion.

11. The flexible membrane of claim 5, wherein an outermost concentric annular flap of the plurality of concentric flaps comprises a vertical portion extending from the main portion, a horizontal portion extending from the vertical portion, and a thick rim along an outer edge of the horizontal portion, the thick rim configured to be secured to a base assembly.

12. The flexible membrane of claim 11, wherein the horizontal portion has a smaller thickness than the vertical portion.

13. The flexible membrane of claim 11, wherein a ratio of length of the horizontal portion to length of the vertical portion is between about 1.5 and 2.0.

14. The flexible membrane of claim 5, wherein at least one of the concentric annular flaps includes a notch at a juncture between the at least one of the concentric annular flaps and the main portion.

* * * * *